US005166730A

United States Patent [19]

Urabe

[11] Patent Number: 5,166,730

[45] Date of Patent: Nov. 24, 1992

[54] IMAGE FORMING APPARATUS HAVING AUTOMATIC INITIAL ADJUSTMENT SYSTEM

[75] Inventor: Kenji Urabe, Yokohama, Japan

[73] Assignee: Kabushiki Kaisha Toshiba, Kawasaki, Japan

[21] Appl. No.: 429,647

[22] Filed: Oct. 31, 1989

[30] Foreign Application Priority Data

Oct. 31, 1988 [JP] Japan ..... 63-275637

[51] Int. Cl.[5] ..... G03G 21/00; G03G 15/08

[52] U.S. Cl. ..... 355/208; 355/246

[58] Field of Search ..... 355/204, 206, 208, 246; 358/300

[56] References Cited

U.S. PATENT DOCUMENTS

| | | | |
|---|---|---|---|
| 4,901,115 | 2/1990 | Nakamura et al. | 355/246 |
| 4,916,488 | 4/1990 | Kimura | 355/208 |
| 5,012,286 | 4/1991 | Kawano et al. | 355/246 |
| 5,031,123 | 7/1991 | Narukawa | 355/208 X |

FOREIGN PATENT DOCUMENTS

| | | |
|---|---|---|
| 112928 | 7/1984 | European Pat. Off. . |
| 195655 | 9/1986 | European Pat. Off. . |
| 3049339 | 9/1981 | Fed. Rep. of Germany . |
| 3800248 | 7/1988 | Fed. Rep. of Germany . |

*Primary Examiner*—Fred L. Braun
*Attorney, Agent, or Firm*—Foley & Lardner

[57] ABSTRACT

An initial adjustment system of a copying machine for forming an image of an original onto an image forming media, which includes a detector for detecting a concentration of a toner used in the copying machine to provide a detection result, and a microcomputer for performing an adjustment of the toner concentration in accordance with the detection result. The adjustment by the microcomputer is performed in accordance with a predetermined adjustment sequence when the image forming apparatus is to be adjusted at an installation place. A reference value for the desired toner concentration is adjusted a number of times when the copier is initially installed. The cleaner blade is lubricated as part of the installation.

14 Claims, 12 Drawing Sheets

IMAGE FORMING APPARATUS HAVING AUTOMATIC INITIAL ADJUSTMENT SYSTEM

BACKGROUND OF THE INVENTION

1. Field of the Invention

The present invention relates to an image forming apparatus such as an electric copying machine and, more particularly, to an image forming apparatus having an adjustment mode for various adjustments performed upon unpacking.

2. Description of the Related Art

An electric copying machine, for example, often includes a developing unit for developing an electrostatic latent image on a photosensitive body by a magnetic brush system using a two-component developer material consisting of a toner and a carrier.

In a copying machine using such a developing unit, in order to maintain the image concentration constant, a toner concentration of a developer material contained in the developing unit is detected by a toner concentration sensor. A detection signal from the sensor is compared with a predetermined reference value, and a toner supply means is operated in accordance with the comparison result to supply a toner, thereby always maintaining the toner concentration in the developer material, constant.

A magnetic sensor is sometimes used as the toner concentration sensor. This magnetic sensor detects the toner concentration by detecting a magnetic resistance of the developer material, which changes in accordance with a mixing ratio between a toner and a carrier, and converts a detection signal into an analog voltage signal. The magnetic sensor has a structure in which its output voltage can be varied in accordance with an externally input control voltage.

In a copying machine in which such a magnetic sensor is used as a toner concentration sensor in order to control a toner concentration in a developer material, the toner concentration sensor must be adjusted when the machine is unpacked. That is, when a copying machine is delivered to a user, a serviceman opens its package, performs various initial adjustments, and installs the machine in an operative state. One of the various adjustments performed upon unpacking is an adjustment of a toner concentration sensor. In the toner concentration sensor adjustment, in order to maintain an image concentration constant, an output voltage of the toner concentration sensor is set to be a reference voltage with respect to a reference toner concentration of a developer material.

In order to set the output voltage of the toner concentration sensor to be the reference voltage with respect to the reference toner concentration, a serviceman inputs a control voltage for varying an output signal to the toner concentration sensor, and checks the output voltage from the toner concentration sensor by a digital voltmeter while varying the control voltage by a variable resistor. For this reason, it is difficult to perform an adjustment with high precision, and the adjustment requires a long time. That is, the adjustment operation is very cumbersome.

A copying machine of this type includes a cleaner. After a toner image formed on a photosensitive body by development by a developing unit is transferred onto paper, a rubber blade of the cleaner is brought into contact with the surface of the photosensitive body, thereby scraping off (cleaning) any toner remaining on the surface of the photosensitive body. An adjustment operation of the cleaner is performed as one of the various adjustments performed upon unpacking.

In this cleaner adjustment, the photosensitive body is rotated a predetermined number of times while the blade is in contact with the surface of the drum-like photosensitive body, thereby obtaining a satisfactory contact state of the blade with respect to the surface of the photosensitive body. In this case, since the blade is made of rubber and unused, it is turned up upon rotation of the photosensitive body. In the worst case, the blade may be broken or the surface of the photosensitive body may be damaged.

In order to prevent turn-up of the blade, therefore, a serviceman applies a lubricant called a batting powder to the surface of the photosensitive body, thereby improving slidable contact. For this reason, since the lubricant must be applied to the surface of the photosensitive body, adjustment becomes troublesome and requires a long time. That is, the adjustment operation is very cumbersome.

SUMMARY OF THE INVENTION

The present invention has been made to solve the problem in which it is difficult to adjust a toner concentration detecting means with high precision upon unpacking, and adjustment requires much labor and time, i.e., an adjustment operation is very cumbersome. It has as its first object to provide an image forming apparatus in which an adjustment of a toner concentration detecting means can be automatically performed with high precision, the adjustment does not require much labor or time, adjustment time can be reduced, and the adjustment operation can be simplified.

The present invention has been made also to solve the problem in which adjustment of a cleaning means using a blade, performed upon unpacking, is troublesome and requires much labor and time, i.e., an adjustment operation is very cumbersome. The second object is to provide an image forming apparatus in which adjustment of a cleaning means can be automatically performed, the adjustment does not require much labor or time, adjustment time can be reduced, and the adjustment operation can be simplified.

It is the third object of the present invention to provide method of automatically adjusting the toner concentration detecting means and/or cleaning means.

The present invention comprises, in an image forming apparatus: an image carrier on which a latent image is formed; a developing means for developing a latent image formed on the image carrier by using a toner, thereby forming a toner image; transferring means for transferring the toner image on the image carrier onto a transferring material; cleaning means for bringing a blade into contact with the surface of the image carrier after the toner image is transferred by the transferring means, thereby removing the toner remaining on the image carrier; toner concentration detecting means for detecting a toner concentration in a developer material in the developing means and converting a detection signal into an electrical signal, an output signal being variable by an externally input signal; and a toner concentration control means for controlling the toner concentration in the developer material, a first adjustment mode for performing an operation in which a signal for varying the output signal to be supplied to the toner concentration detecting means is varied to automatically set an output signal supplied from the toner concentration detecting means when a reference toner concentration is obtained to be a reference value and/or a second adjustment mode for performing an operation in which a toner is applied to the surface of the image carrier by the developing means and then the surface of the image carrier is cleaned by the cleaning means.

By providing the first adjustment mode for performing the operation in which the signal, to be supplied to the toner concentration detecting means, is varied to automatically set the output signal supplied from the toner concentration detecting means when the reference toner concentration is obtained to be the reference value, an adjustment of the toner concentration detecting means can be automatically performed with high precision. Therefore, an adjustment time can be reduced and an adjustment operation can be simplified without requiring much labor or time, unlike a conventional apparatus, thereby realizing a great efficiency especially upon unpacking.

In addition, by providing the second adjustment mode for performing the operation in which a toner is applied to the surface of the image carrier by the developing means and then the surface of the image carrier is cleaned by the cleaning means, the cleaning means can be automatically adjusted. In this case, since the toner applied to the image carrier serves as a conventional lubricant (batting powder), turn-up of the blade caused by the image carrier can be prevented without applying a lubricant to the image carrier. Therefore, an adjustment time can be reduced and an adjustment operation can be simplified without much labor or time unlike a conventional apparatus.

DETAILED DESCRIPTION OF THE PREFERRED EMBODIMENTS

Figure 1:
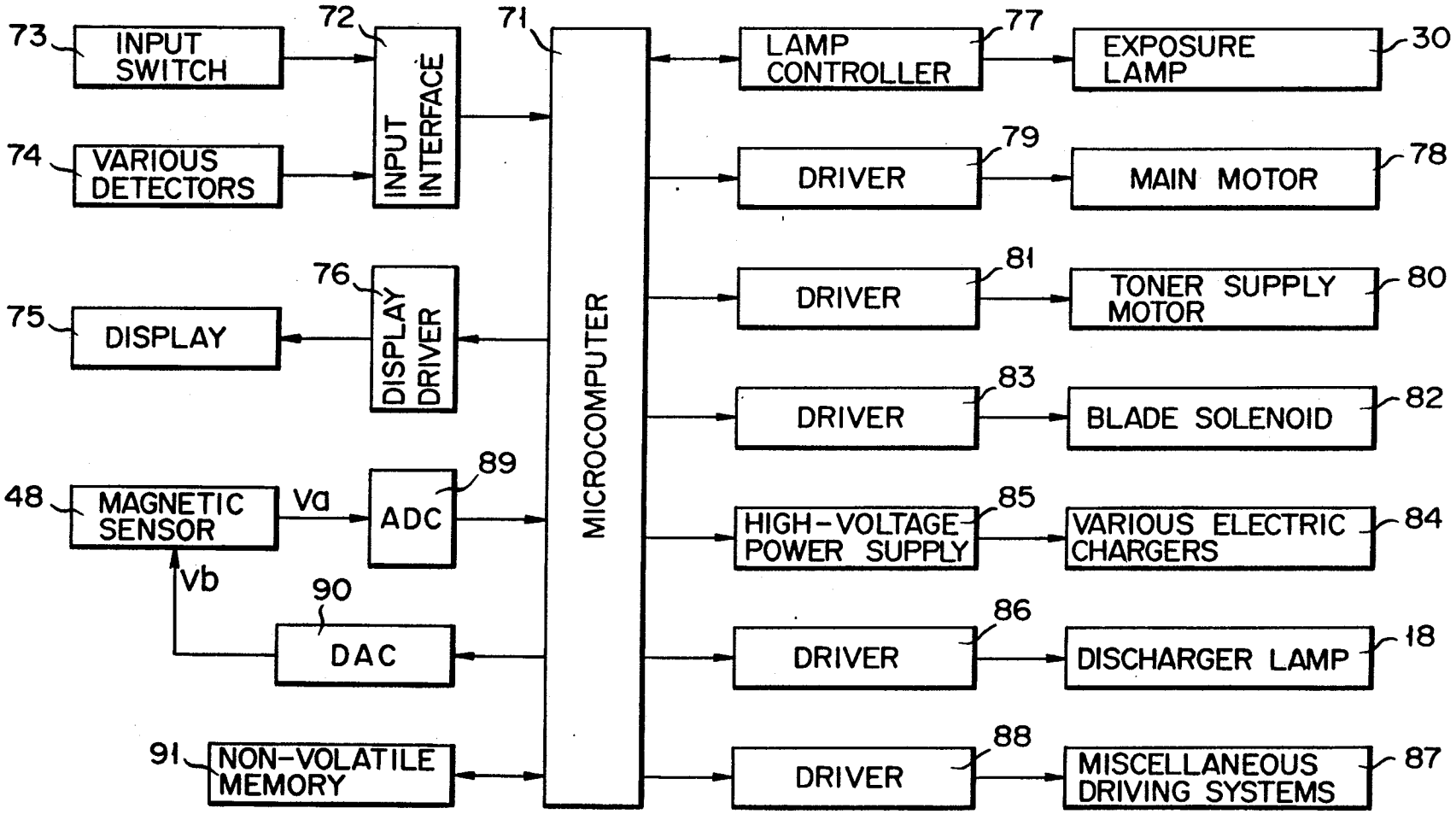
FIG. 1 is a block diagram showing a schematic configuration of an image forming apparatus (e.g., an electric copying machine) according to the present invention.

Preferred embodiments of this invention will be described with reference to the accompanying drawings. In the description, the same or functionally equivalent elements are denoted by the same or similar reference numerals, to simplify the description.

Figure 2:
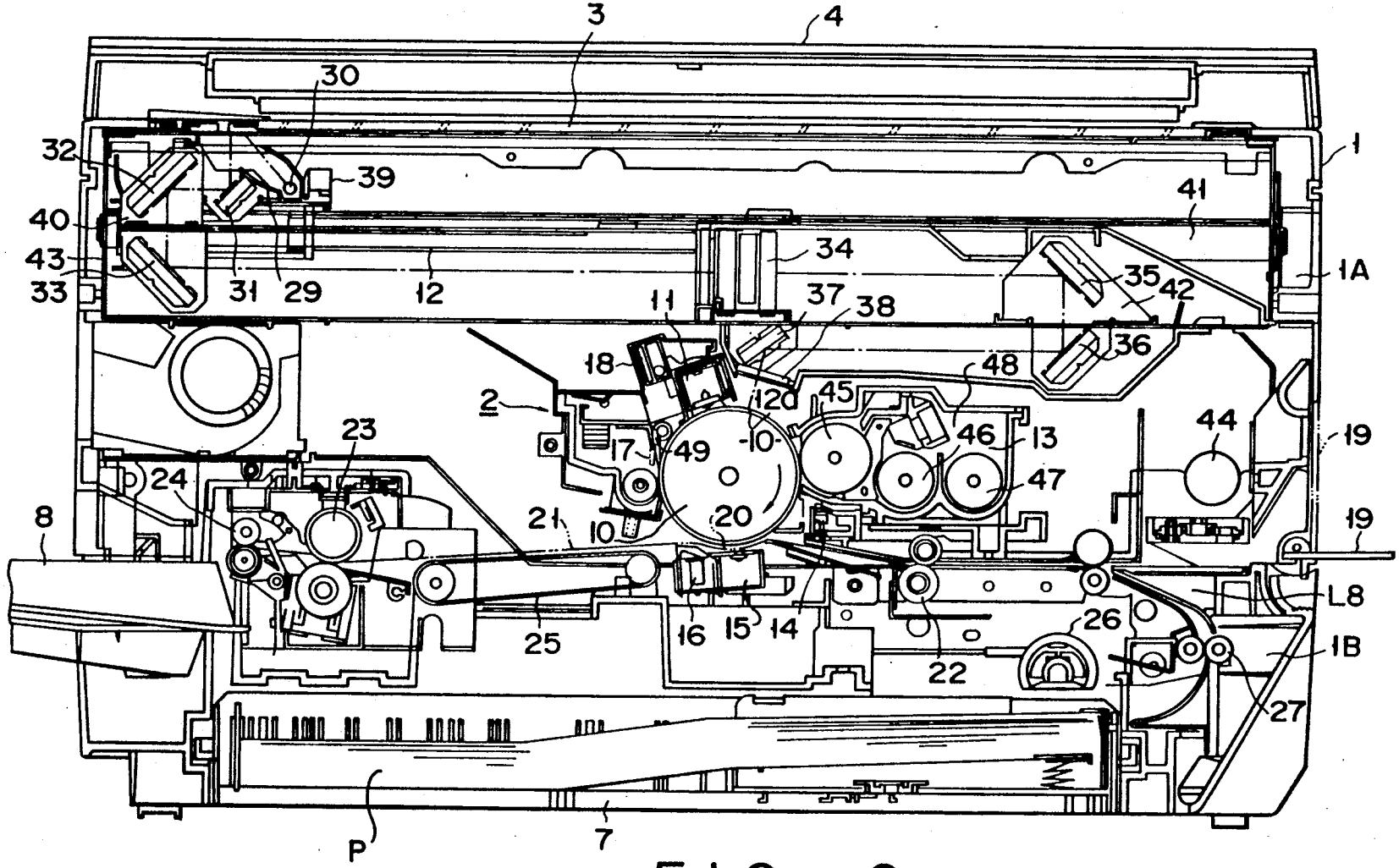
FIG. 2 is a vertical sectional view showing an internal structure of an electric copying machine according to the present invention.
Figure 3:
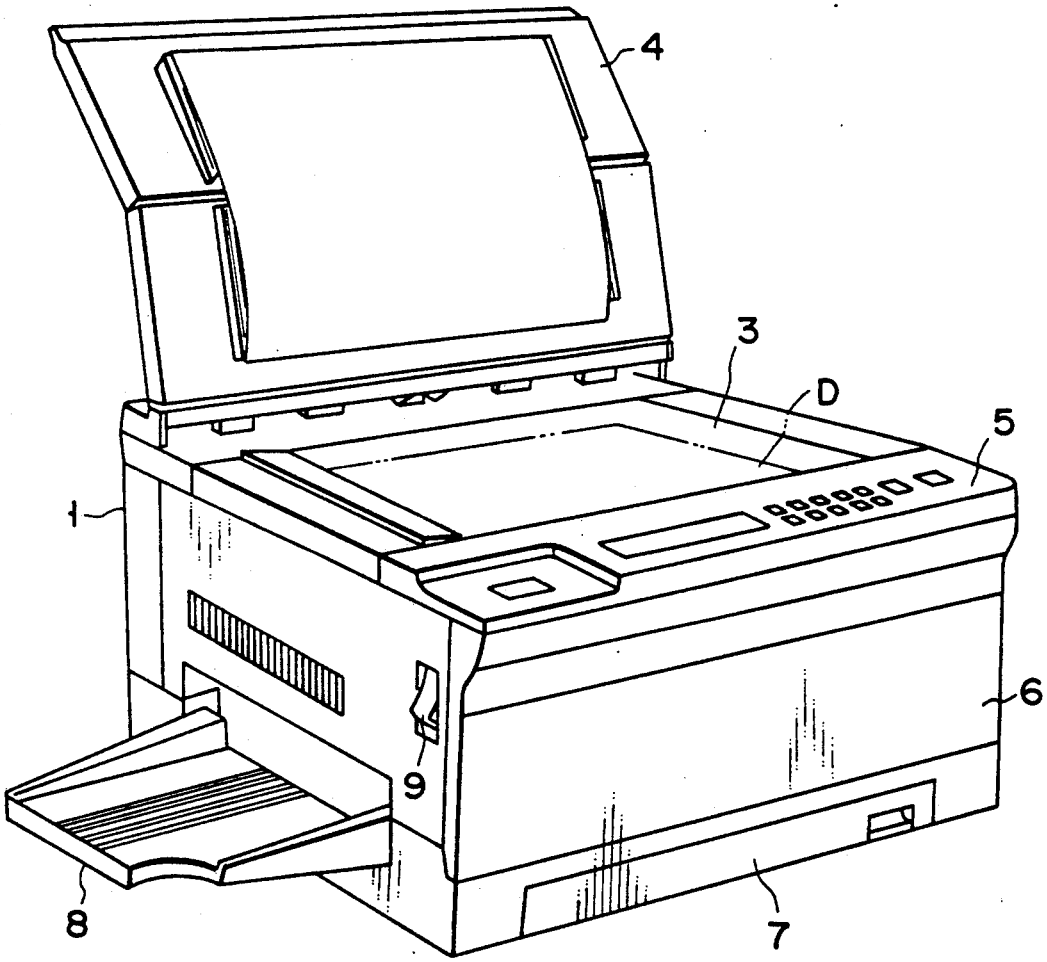
FIG. 3 is a perspective view showing the exterior of the electric copying machine.

FIGS. 2 and 3 show an electric copying machine as an embodiment of an image forming apparatus according to the present invention. Apparatus main body 1 incorporates image formation process arranging means 2 for charging, exposure, development, transfer, removal, cleaning, discharging, and fixing. Document table (transparent glass plate) 3 for setting a document D is located on the upper surface of main body 1, and document holding cover 4 for holding document D is arranged to be opened/closed on table 3. Manipulation panel 5 is arranged at the upper surface front edge portion of main body 1.

Front-surface cover 6 is arranged to be opened/closed on the front surface of main body 1, and paper-feed cassette 7 containing paper (transfer material) P such as normal paper to be supplied to image formation process arranging means 2 is detachably arranged on the front surface lower portion. Paper-exhaust tray 8 for stacking fixed paper P and power switch 9 are located at the left side of main body 1.

The image formation process arranging means 2 is arranged as follows. Drum-like photosensitive body 10, as an image carrier, is located at substantially the center of the main body 1. Electric charger 11, exposure portion 12*a* of exposure optical system 12, developing unit 13, pre-transfer discharger lamp 14, transfer charger 15, separation charger 16, cleaner (cleaning means) 17, and discharge lamp 18 are sequentially arranged around photosensitive body 10.

Paper conveyor path 21 is formed in main body 1. Path 21 guides paper P, automatically supplied from cassette 7 or manually supplied from manual paper-feed table 19, to paper-exhaust tray 8 located at the left side of main body 1 via image transfer unit 20 between photosensitive body 10 and transfer charger 15. Registration roller pair 22 is located at the upstream side of image transfer unit 20 of path 21, and fixing device 23 and paper-exhaust roller pair 24 are located at its downstream side. Conveyor belt unit 25 is located between separation charger 16 and fixing device 23.

Pick-up roller 26, for picking up paper P one by one, and separating conveyor means 27 are located near a mounting portion of cassette 7. Means 27 includes a conveyor and separating rollers for receiving paper P picked up by pick-up roller 26 and supplying paper P into a first branch conveyor path which forms the upstream side of paper conveyor path 21. Manual feeding roller pair 28 is located at a confluent portion between the first branch conveyor path and a second branch conveyor path for manual feeding.

In exposure optical system 12, document D set on document table 3 located on the upper surface of main body 1 is illuminated by exposure lamp 30 surrounded in back by reflector 29. Light reflected by document D is guided to lens 34 via first mirror 31, second mirror 32, and third mirror 33. The light transmitted through lens 34 is guided to photosensitive body 10 via fourth mirror 35, fifth mirror 36, sixth mirror 37, and slit glass 38.

Exposure lamp 30 surrounded by reflector 29 and first mirror 31 are mounted on first carriage 39 which can reciprocate along the lower surface of document table 3. Second and third mirrors 32 and 33 are mounted on second carriage 40 which moves in the same direction at a ½ speed of the speed of first carriage 39. When carriages 39 and 40 move from the left to right side in FIG. 2, document D set on table 3 is optically scanned to slit-expose an image corresponding to an image of document D on photosensitive body 10. Note that fourth and fifth mirrors 35 and 36 are incorporated as a unit in mirror support member 42.

Exposure optical system 12 has a unit structure integrally incorporated in frame 43. Therefore, system 12 can be handled as a unit.

Main body 1 is divided into upper unit 1A and lower unit 1B substantially by paper conveyor path 21. If necessary, upper unit 1A can be pivoted through 25° about support shaft 44 as a pivoting center provided at the paper-feed side. Shaft 44 is a shaft portion of a torsion bar for normally biasing upper unit 1A in an opening direction.

In the above arrangement, photosensitive body 10 rotates in a direction indicated by an arrow in FIG. 2, and its surface is uniformly charged by electric charger 11. First carriage 39 moves along document table 3 with exposure lamp 30 kept ON, and in synchronism with this movement, second carriage 40 moves in the same direction at a ½ speed of that of first carriage 39. As a result, document D on table 3 is optically scanned, and an image of document D is imaged on photosensitive body 10 by exposure optical system 12, thereby forming an electrostatic latent image.

The electrostatic latent image formed on the surface of photosensitive body 10 faces developing unit 13, and is developed into a toner image. Thereafter, the toner image on photosensitive body 10 is supplied to image transfer unit 20 opposing transfer charger 15 and transferred on paper P supplied by resistration roller pair 22. Paper P, on which the toner image is transferred, is separated from the surface of photosensitive body 10 by separation charger 16, and guided to fixing device 23 via conveyor belt unit 25, thereby fixing the transferred toner image. Thereafter, paper P is exhausted to paper-exhaust tray 8 by paper-exhaust roller pair 24.

The surface of photosensitive body 10 faces cleaner 17 after the toner image is transferred onto paper P, thereby cleaning the remaining toner. The surface is then discharged by discharge lamp 18 to prepare for the next copying operation.

Developing unit 13 performs development by using a two-component developer material consisting of a toner and a carrier. Unit 13 includes: magnetic roller (development roller) 45 for forming a magnetic brush of the developer material on its surface, thereby conveying the developer material to a sliding portion with respect to photosensitive body 10; stirring conveyor body 46 for stirring and conveying a toner supplied from a toner supply unit (toner hopper) (not shown); developer material stirring body 47; and magnetic sensor 48 as a toner concentration sensor (toner concentration detecting means) for detecting a toner concentration in the developer material. Magnetic sensor 48 detects a toner concentration by detecting a magnetic resistance in the developer material which changes in accordance with a mixing ratio between the toner and carrier, and converts a detection signal into an analog voltage signal, as will be described in detail below.

A toner hopper (not shown) containing a supply toner is located at one end of developing unit 13. A toner supply roller (not shown) arranged on the bottom portion of the toner hopper is rotated by a toner supply motor to supply the toner to the toner hopper into developing unit 13.

Cleaner 17 has rubber blade 49. The distal end of blade 49 is urged against the surface of photosensitive body 10 to scrape off (clean) the toner from the surface of body 10.

Figure 4:
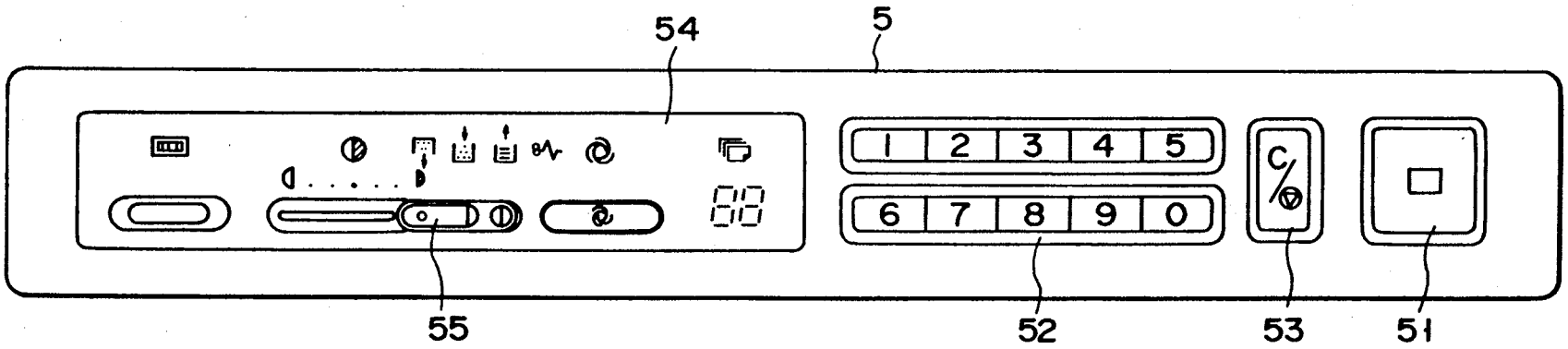
FIG. 4 is a plan view of a manipulation panel of the electric copying machine.

FIG. 4 shows manipulation panel 5. Panel 5 includes copy key 51 for designating copy start, ten keys 52 for setting the number of copies, clear/stop key 53 for clearing a set value of the number of copies or stopping a copy operation, liquid crystal display unit 54 for displaying an operation state of each unit or the number of copies, and exposure amount setting unit 55 for setting an exposure amount.

Figure 5:
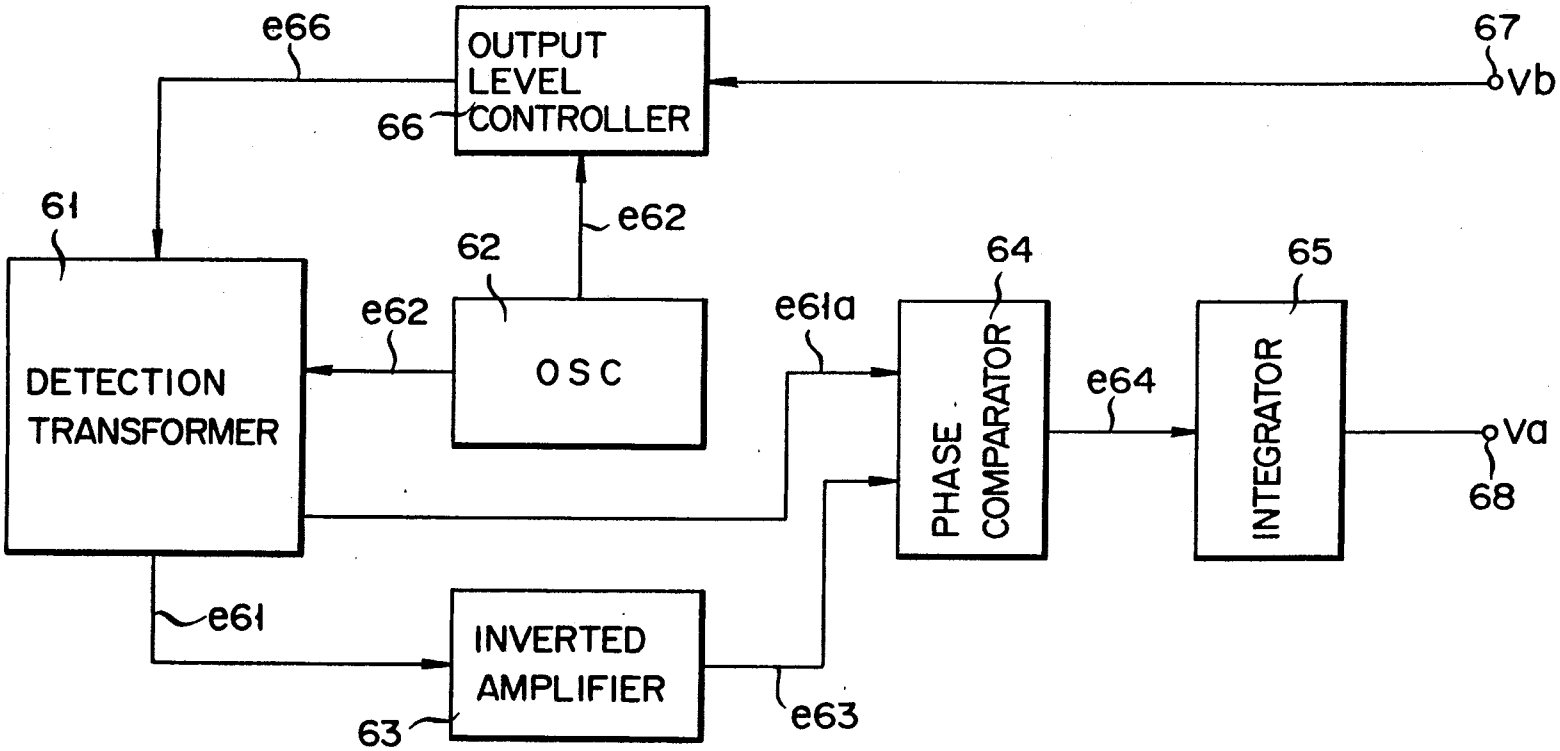
FIG. 5 is a block diagram showing a configuration of a magnetic sensor according to the present invention.

FIG. 5 schematically shows an arrangement of magnetic sensor 48. Sensor 48 is constituted by detection transformer 61, oscillator (OSC) 62, inverted amplifier 63, phase comparator 64, integrator 65, and output level controller 66.

That is, control voltage input terminal 67 is connected to output level controller 66, which is connected to detection transformer 61 and OSC 62. OSC 62 is connected to transformer 61 and phase comparator 64. Inverted amplifier 63 is connected to transformer 61 and comparator 64. Comparator 64 is connected to integrator 65 which is connected to output terminal 68.

Upon power-on of the above arrangement, OSC 62 starts RF oscillation, and RF oscillation signal e62 is supplied to detection transformer 61. An RF voltage corresponding to signal e62 is generated in a primary coil of transformer 61, thereby generating an induced electromotive force inversely proportional to a toner concentration in a developer material in a secondary coil of transformer 61. Voltage e66 generated from output level controller 66 in accordance with analog control voltage Vb, externally input to control voltage input terminal 67, is added to the electromotive force. An output corresponding to the induced electromotive force+voltage e66 is supplied to inverted amplifier 63. Signal e63 subjected to inverted wave-shaping in amplifier 63 is phase-compared with voltage e61*a* generated in the primary coil of transformer 61. Output e64 from the comparator 64 is integrated by integrator 65 and output as output voltage Va to output terminal 68.

Figure 6:
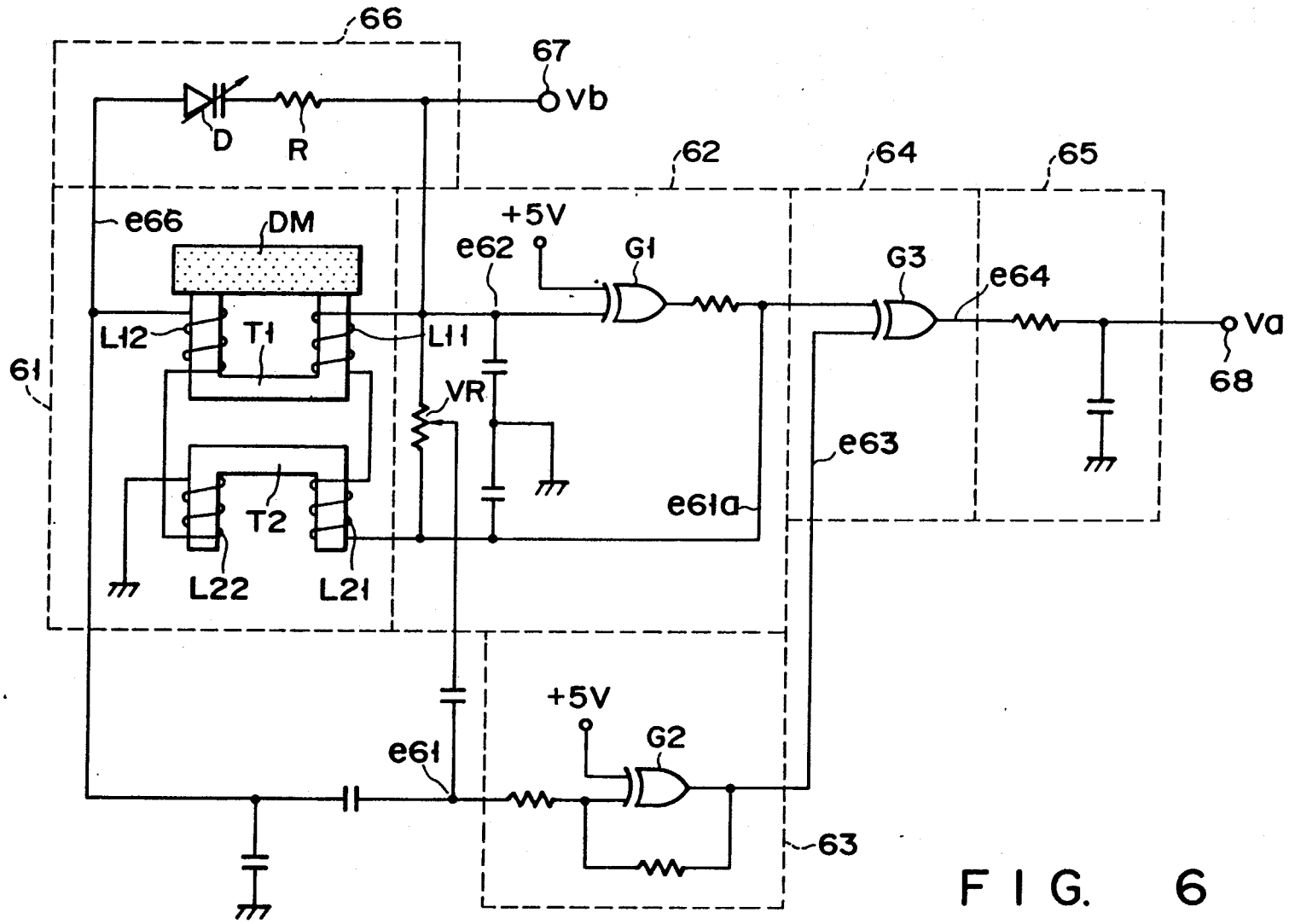
FIG. 6 is a detailed circuit diagram of the magnetic sensor shown in FIG. 5.

FIG. 6 shows a detailed circuit diagram of magnetic sensor 48. That is, detection transformer 61 comprises two magnetic transformers T1 and T2 each having coils of the same winding shape formed on a single core. One magnetic transformer T1 for detection is arranged in developer material DM. The other magnetic transformer T2 serves as a reference. Magnetic body of the transformer T2 is adjusted such that an electromotive force corresponding to a reference toner concentration of the developer material is induced.

Gate circuit (exclusive OR gate) G1 constituting oscillator 62 serves as a Colpitts oscillator. Gate G1 oscillates at about, e.g., 350 kHz and drives primary coils (drive coils) L11 and L21 of transformers T1 and T2. Secondary coils (induction coils) L12 and L22 of transformers T1 and T2 are connected so that electromotive forces are induced in opposite directions. Therefore, a difference is obtained between the electromotive forces of the respective coils. An activation output from the coils is subjected to inverted wave-shaping by gate circuit (exclusive OR gate) G2 constituting inverted amplifier 63, and phase-compared with a drive waveform by gate circuit (exclusive OR gate) G3 constituting phase comparator 64. An output from gate G3 is integrated and output as analog voltage Va.

Variable-capacitance diode D and resistor R constitute output level controller 66 and are connected between control voltage input terminal 67 and magnetic transformer T1. The capacitance of diode D is varied in accordance with control voltage Vb externally input to terminal 67, thereby varying output voltage Va.

FIG. 1 shows an overall control system. That is, reference numeral 71 denotes a microcomputer as a main control unit for controlling the overall system. Microcomputer 71 is connected to input switch 73 such as various keys on manipulation panel 5 and various detectors (e.g., switches and sensors) required for other control operations via input interface 72 such as a data selector. Microcomputer 71 is also connected to display unit 54 on manipulation panel 5, display driver 76 for driving display 75, and lamp controller 77 for controlling exposure lamp 30.

In addition, microcomputer 71 is connected to driver 79 for driving main motor 78, driver 81 for driving toner supply motor 80 for driving the toner supply roller (not shown), driver 83 for driving blade solenoid 82 for driving blade 49 of cleaner 17, high-voltage power supply 85 for driving various electric chargers 84 (chargers 11, 15, and 16), driver 86 for driving discharge lamp 18, and driver 88 for driving miscellaneous driving systems 87 (e.g., motors, clutches, and solenoids).

Output voltage Va from magnetic sensor 48 is supplied to A/D converter (ADC) 89, converted into multi-bit digital data, and supplied to microcomputer 71. Microcomputer 71 sends to D/A converter (DAC) 90 adjustment value data (control voltage data Vb) for adjusting output voltage Va from sensor 48 to be a reference voltage with respect to a reference toner concentration. The data is converted into analog control voltage Vb by DAC 90 and supplied to control voltage input terminal 67 of sensor 48.

Microcomputer 71 is also connected to non-volatile memory (storage means) 91 for storing, e.g., the adjustment value data for adjusting output voltage Va from sensor 48 to be the reference voltage with respect to the reference toner concentration.

An operation in the above arrangement will be described below.

An adjustment operation performed upon unpacking will be described with reference to flow charts shown in FIGS. 7A to 8B. By a specific operation on manipulation panel 5, e.g., by turning on power switch 9 while simultaneously depressing two predetermined keys of ten keys 52, a toner concentration sensor adjustment mode is set. By depressing copy key 51, microcomputer 71 starts an adjustment operation.

That is, a 3 min. timer is set in step S1, main motor 78 is turned on in step S2 to stir the developer material in developing unit 13, and the flow advances to step S3. In step S3, microcomputer 71 checks whether three minutes have elapsed. If three minutes have elapsed, microcomputer 71 determines that flowability of the developer material is stabilized, and the flow advances to step S4. In step S4, initial data (digital value=128) $A_0$ stored in non-volatile memory 91 is read out and output to DAC 90. DAC 90 converts input initial data $A_0$ into corresponding control voltage Vb and supplies control voltage Vb to control voltage input terminal 67 of magnetic sensor 48. Therefore, output voltage Va from magnetic sensor 48 is changed in accordance with input control voltage Vb.

In step S5, data output from ADC 89 is read out as input data $I_1$ and compared with reference data $S_0$ stored in memory 91. If a relation $[I_1 \leqq S_0]$ is satisfied, the flow advances to step S6. In step S6, a value (64) which is ½ of initial data (128) $A_0$ is added to initial data $A_0$ to obtain adjustment value data $A_1$, and the flow advances to step S7. If the relation $[I_1 \leqq S_0]$ is not satisfied in the comparison in step S5, the flow advances to step S8. In step S8, the value (64) which is ½ of initial data (128) $A_0$ is subtracted from initial data $A_0$ to obtain adjustment value data $A_1$, and the flow advances to step S7.

In step S7, adjustment value data $A_1$ obtained in step S6 or S8 is output to DAC 90, and the flow advances to step S9. In step S9, input data $I_1$ is read out and compared with reference data $S_0$ again. If the relation $[I_1 \leqq S_0]$ is satisfied, the flow advances to step S10. In step S10, a value (32) which is ¼ of initial data (128) $A_0$ is added to previously obtained adjustment value data $A_1$ to obtain new adjustment value data $A_1$, and the flow advances to step S11. If the relation $[I_1 \leqq S_0]$ is not satisfied in the comparison in step S9, the flow advances to step S12. In step S12, the value (32) which is ¼ of initial data (128) $A_0$ is subtracted from previously obtained adjustment value data $A_1$ to obtain new adjustment data $A_1$, and the flow advances to step S11.

In step S11, adjustment value data $A_1$ obtained in step S10 or S12 is output to DAC 90, and the flow advances to step S13. In step S13, input data $I_1$ is read out and compared with reference data S0 again. If the relation $[I_1 \leqq S_0]$ is satisfied, the flow advances to step S14. In step S14, a value (16) which is ⅛ of initial data (128) $A_0$ is added to previously obtained adjustment value data $A_1$ to obtain new adjustment value data $A_1$, and the flow advances to step S15. If the relation $[I_1 \leqq S_0]$ is not satisfied in the comparison in step S13, the flow advances to step S16. In step S16, the value (16) which is ⅛ of initial data (128) $A_0$ is subtracted from previously obtained adjustment value data $A_1$ to obtain new adjustment value data $A_1$, and the flow advances to step S15.

In step S15, adjustment value data $A_1$ obtained in step S14 or S16 is output to the DAC 90, and the flow advances to step S17. In step S17, input data $I_1$ is read out and compared with reference data $S_0$ again. If the relation $[II_1 \leqq S_0]$ is satisfied, the flow advances to step S18. In step S18, a value (8) which is 1/16 of initial data (128) $A_0$ is added to previously obtained adjustment value data $A_1$ to obtain new adjustment value data $A_1$, and the flow advances to step S19. If the relation $[I_1 \leqq S_0]$ is not satisfied in the comparison in step S17, the flow advances to step S20. In step S20, the value (8) which is 1/16 of initial data (128) $A_0$ is subtracted from previously obtained adjustment value data $A_1$ to obtain new adjustment value data $A_1$, and the flow advances to step S19.

In step S19, adjustment value data $A_1$ obtained in step S18 or S20 is output to DAC 90, and the flow advances to step S21. In step S21, input data $I_1$ is read out and compared with reference data $S_0$. If the relation $[I_1 \leqq S_0]$ is satisfied, the flow advances to step S22. In step S22, a value (4) which is 1/32 of the initial data (128) $A_0$ is added to previously obtained adjustment value data $A_1$ to obtain new adjustment value data $A_1$, and the flow advances to step S23. If the relation $[I_1 \leqq S_0]$ is not satisfied in the comparison in step S21, the flow advances to step S24. In step S24, the value which is 1/32 of initial data (128) $A_0$ is subtracted from previously obtained adjustment value data $A_1$ to obtain new adjustment value data $A_1$, and the flow advances to step S23.

In step S23, adjustment value data $A_1$ obtained in step S22 or S24 is output to DAC 90, and the flow advances to step S25. In step S25, input data $I_1$ is read out and compared with reference data $S_0$. If the relation $[I_1 \leqq S_0]$ is satisfied, the flow advances to step S26. In step S26, a value (2) which is 1/64 of initial data (128) $A_0$ is added to previously obtained adjustment value data $A_1$ to obtain new adjustment value data $A_1$, and the flow advances to step S27. If the relation $[I_1 \leqq S_0]$ is not satisfied in the comparison in step S25, the flow advances to step S28. In step S28, the value which is 1/64 of initial data (128) $A_0$ is subtracted from previously obtained adjustment value data $A_1$ to obtain new adjustment value data $A_1$, and the flow advances to step S27.

In step S27, adjustment value data $A_1$ obtained in step S26 or S28 is output to DAC 90, and the flow advances to step S29. In step S29, input data $I_1$ is read out and compared with reference data $S_0$. If the relation $[I_1 \leqq S_0]$ is satisfied, the flow advances to step S30. In step S30, a value (1) which is 1/128 of initial data (128) $A_0$ is added to previously obtained adjustment value data $A_1$ to obtain new adjustment value data $A_1$, and the flow advances to step S31. If the relation $[I_1 \leqq S_0]$ is not satisfied in the comparison in step S29, the flow advances to step S32. In step S32, the value which is 1/128 of initial data (128) $A_0$ is subtracted from previously obtained adjustment value data $A_1$ to obtain new adjustment value data $A_1$, and the flow advances to step S31.

In step S31, adjustment value data $A_1$ obtained in step S30 or S32 is output to DAC 90, and the flow advances to step S33. In step S33, input data $I_1$ is read out again to obtain an absolute value of a difference between input data $I_1$ and reference data $S_0$, and the obtained absolute value is compared with data $V_0$ stored in non-volatile memory 91 and representing an allowable range of the reference voltage with respect to the reference toner concentration. That is, the absolute value of the difference between input data $I_1$ reference data $S_0$ is obtained, and whether the absolute value falls within the allowable range of the reference voltage with respect to the reference toner concentration is determined.

If a relation $[|I_1-S_0| \leqq V_0]$ is not satisfied in the comparison in step S33, the flow advances to step S34. In step S34, whether the processing from steps S4 to S33 is repeated M times (e.g., five times) is checked. If the processing is not repeated M times, the flow returns to step S4, and the above operation is repeated. If it is determined that the processing is repeated M times in step S34, the flow advances to step S35. In step S35, "sensor adjustment is disabled" is displayed on display unit 54 of manipulation panel 5, and main motor 78 is turned off to end the operation in the toner concentration sensor adjustment mode.

If the relation $[|I_1-S_0| \leqq V_0]$ is satisfied in the comparison in step S33, the flow advances to S36. In step S36, adjustment value data $A_1$ obtained in step S30 or S32 is stored in memory 91 as final adjustment value data, i.e., adjustment value data for setting the output voltage Va from magnetic sensor 48 to the reference voltage with respect to the reference toner concentration, and main motor 78 is turned off to end the operation in the toner concentration sensor adjustment mode.

When the operation in the toner concentration adjustment mode is ended as described above, microcomputer 71 automatically sets a cleaner adjustment mode and starts an operation in this mode.

That is, a 2 sec. timer, for example, is set in step S37, and the flow advances to step S38. In step S38, main motor 78 is turned on to rotate photosensitive body 10, and electric charger 11 is turned on to charge the surface of photosensitive body 10, thereby adhering a toner on the surface of photosensitive body 10 by developing unit 13. The flow then advances to step S39. In step S39, whether two seconds have elapsed is checked. If two seconds have elapsed, the flow advances to step S40. In step S40, main motor 78 and charger 11 are turned off, and the flow advances to step S41. In step S41, a 10 sec. timer, for example, is set, and the flow advances to step S42. In step S42, main motor 78 is turned on again, blade solenoid 82 is turned on to urge blade 49 of cleaner 17 against the surface of photosensitive body 10, discharger lamp 18 is powered on, and the flow advances to step S43. In step S43, whether ten seconds have elapsed is checked. Surface cleaning of photosensitive body 10 is executed by this 10-sec. blade depression. After ten seconds have elapsed, the flow advances to step S44. In step S44, main motor 78 and electric charger 11 are turned off, and discharger lamp 18 are powered off, thereby ending the operation in the cleaner adjustment mode.

When the operation in the cleaner adjustment mode is ended, microcomputer 71 advances the flow to step S45. In step S45, a warming-up indicator on display unit 54 of manipulation panel 5 is turned on, and the flow advances to step S46. In step S46, microcomputer 71 waits for completion of warming-up. If warming-up is completed, the flow advances to step S47. In step S47, the warming-up indicator is turned off and "copy OK" is displayed, thereby setting a copy enable condition.

Figure 9:
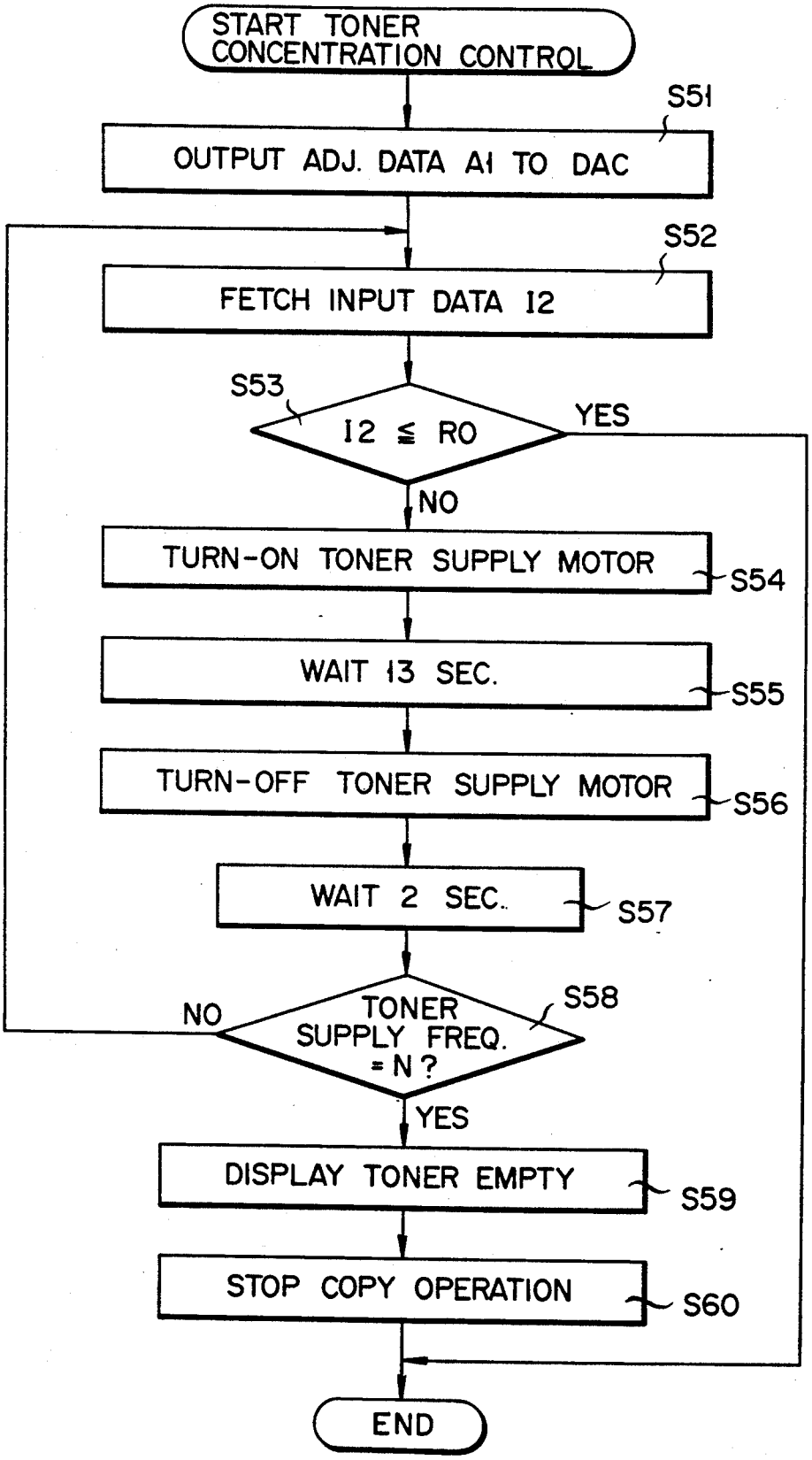
FIG. 9 is flow chart explaining a toner concentration control operation of the invention.

An operation of toner concentration control will be described with reference to a flow chart shown in FIG. 9. Note that this operation is performed by, e.g., an interrupt program of microcomputer 71. In step S51, adjustment value data $A_1$ stored in non-volatile memory 91 as described above is read out and output to DAC 90. DAC 90 converts input data $A_1$ into corresponding control voltage Vb and supplies it to control voltage input terminal 67 of magnetic sensor 48. As a result, output voltage Va from sensor 48 is automatically set to a reference voltage with respect to a reference toner concentration in accordance with input control voltage Vb.

In step S52, toner concentration data output from ADC 89 is loaded as input data $I_2$, and the flow advances to step S53. In step S53, input data $I_2$ is compared with reference concentration data $R_0$ stored in memory 91. If a relation $[I_2 \leqq R_0]$ is not satisfied (i.e., if the detected toner concentration is lower than the reference concentration), the flow advances to step S54. In step S54, toner supply motor 80 is turned on (and driven at a cycle of, e.g., 1.5-sec. ON and 1.2-sec. OFF) to supply a toner to developing unit 13, and the flow advances to step S55.

In step S55, when 13 seconds, for example, elapses, the flow advances to step S56. In step S56, toner supply motor 80 is turned off, and the flow advances to step S57. In step S57, after two seconds, for example, the flow advances to step S58. In step S58, whether a toner supply frequency reaches N times (e.g., 13 times) is checked. If the toner supply frequency does not reach the N times, the flow returns to step S52, and the above operation is repeated.

If the relation $[I_2 \leqq R_0]$ is satisfied (i.e., the detected toner concentration is higher than the reference), the toner concentration control is ended.

If the toner supply frequency reaches the N times in step S58, it is determined that the toner concentration does not exceed a predetermined value even if a toner is supplied, i.e., the amount of toner in the toner hopper is smaller than a predetermined amount, and the flow advances to step 59. In step S59, "toner empty" is displayed on display unit 54 of manipulation panel 5, and the flow advances to step S60. In step S60, the copy operation is stopped to end the toner concentration control.

As described above, by providing the toner concentration sensor adjustment mode (first adjustment mode) for performing the operation in which the control voltage, to be input to the magnetic sensor as the toner concentration sensor, for varying the output voltage from the magnetic sensor, is digitally varied to automatically set the output voltage from the magnetic sensor with respect to the reference toner concentration to be the reference voltage, an adjustment of the magnetic sensor as a toner concentration sensor can be automatically performed with high precision. Therefore, since the adjustment does not require much labor or time unlike in a conventional apparatus, an adjustment time can be reduced and an adjustment operation can be simplified. In particular, setup operations upon unpacking can be easily performed.

In addition, by providing the cleaner adjustment mode (second adjustment mode) for performing the operation in which after the adjustment operation in the toner concentration sensor adjustment mode is ended, the photosensitive body is rotated and the electric charger is turned on to apply a toner to the surface of the photosensitive body by the developing unit, and then the surface of the photosensitive body is cleaned by the cleaner using the blade, an adjustment of the cleaner can be subsequently, automatically performed. In this case, since the toner applied to the photosensitive body serves as a conventional lubricant, no lubricant need be applied to the photosensitive body unlike in a conventional apparatus, thereby preventing turn-up of the blade caused by the photosensitive body. Therefore, since the adjustment does not require much labor or time unlike in a conventional apparatus, an adjustment time can be reduced and an adjustment operation can be simplified. In particular, setup operations upon unpacking can be easily performed.

In the above embodiment, the adjustment mode is set and the adjustment operation is performed by performing the specific operation on the manipulation panel. The present invention, however, is not limited to the above embodiment. For example, a checking means (microcomputer 71 in FIG. 1) for checking, when the power source of the apparatus is turned on, whether the toner concentration sensor and the cleaner are unadjusted may be used so that the adjustment operation is performed only when this checking means determined that the sensor and the cleaner were unadjusted.

Figure 7A:
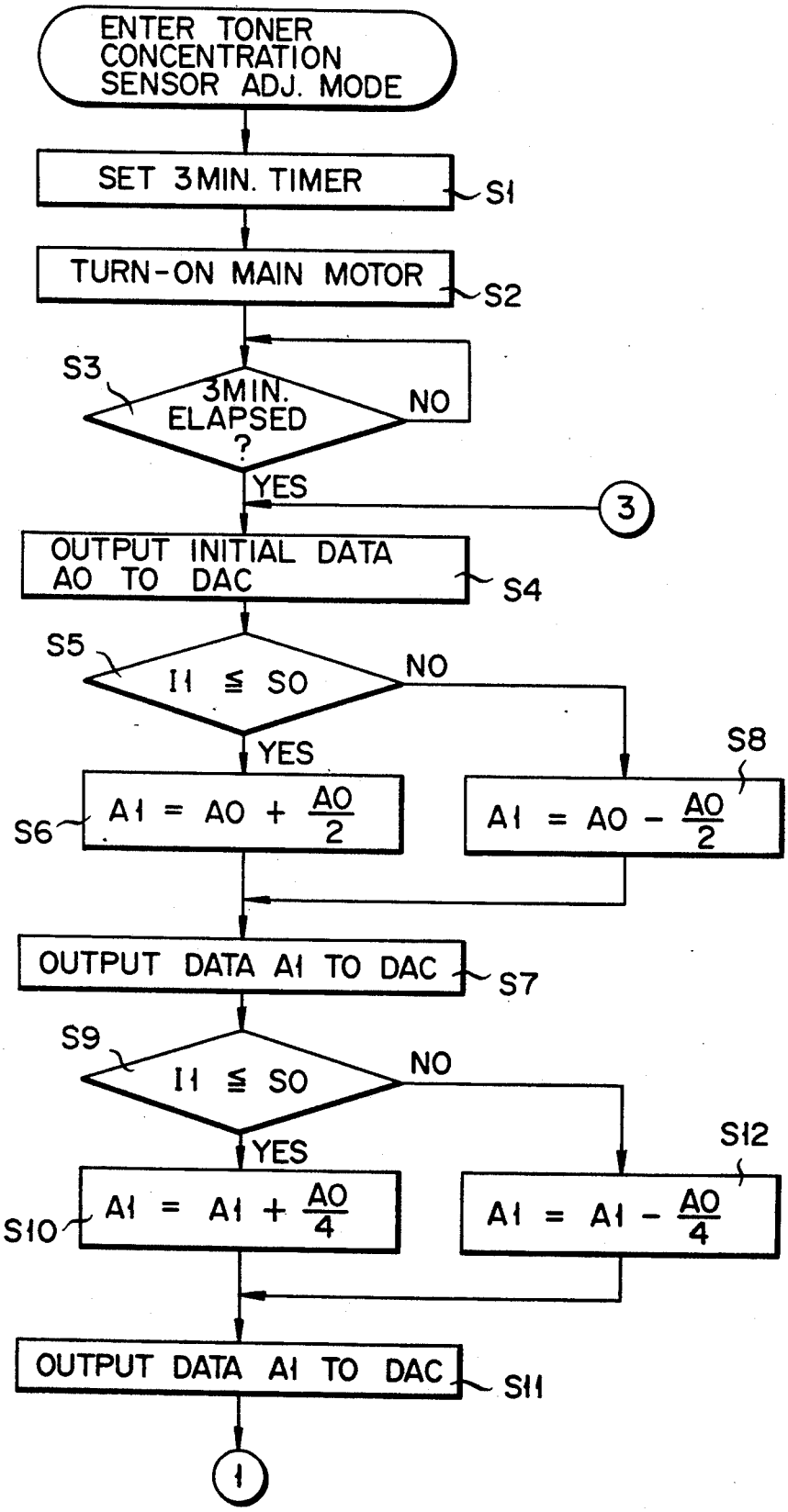
FIGS. 7A–7C are flow charts explaining the operation of a toner concentration sensor adjustment mode of the invention.
Figure 7B:
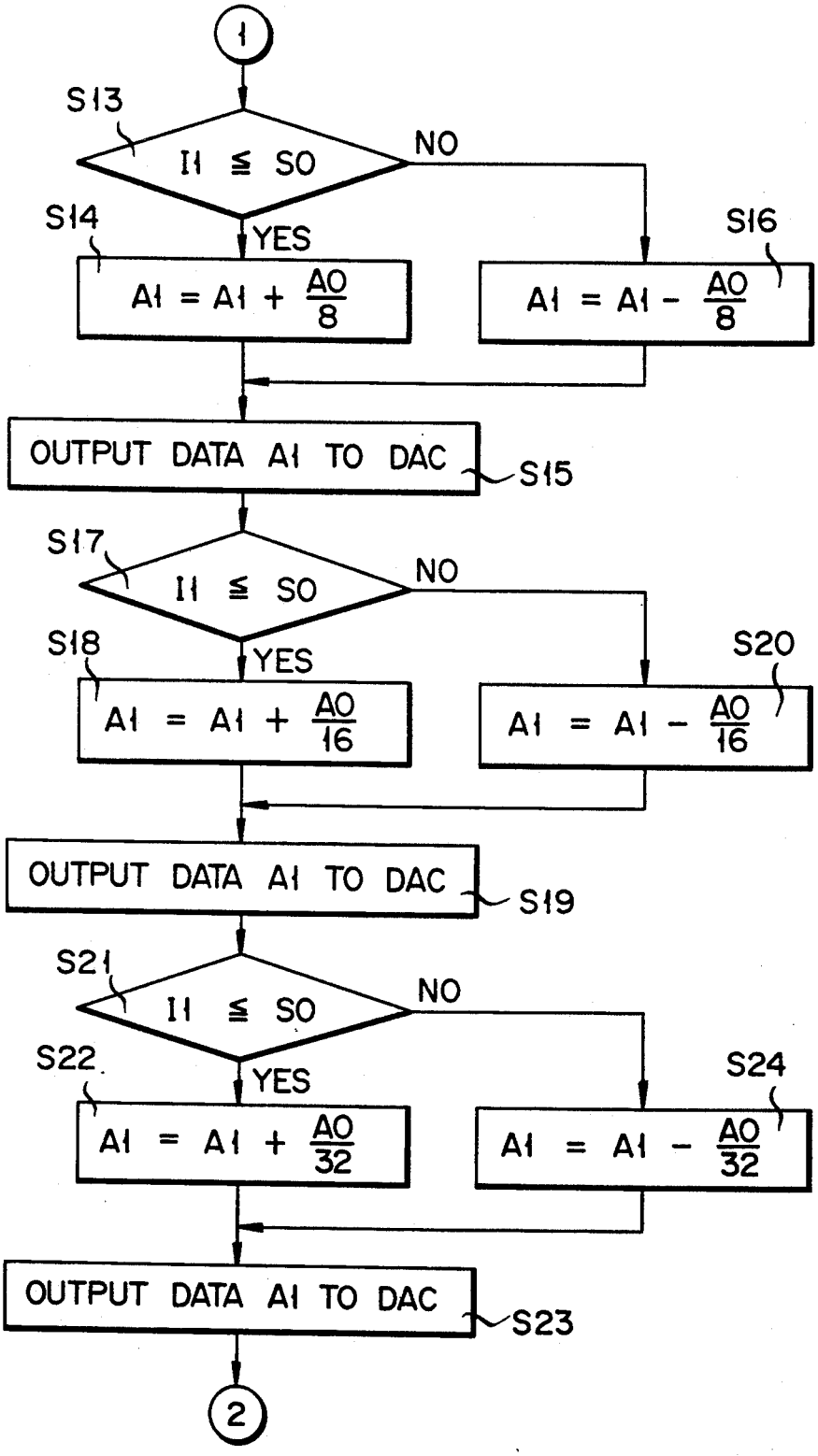
Figure 7C:
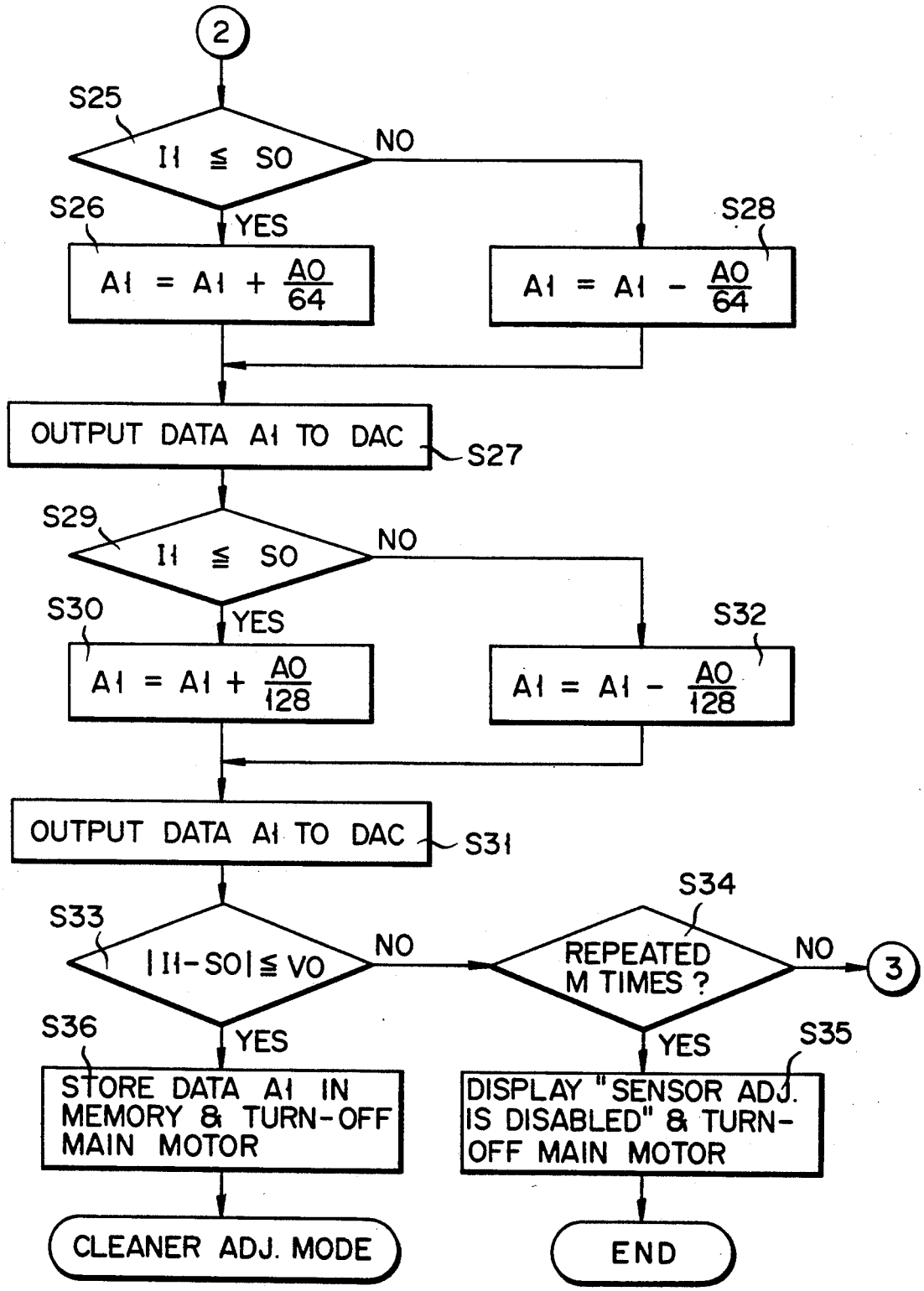
Figure 8A:
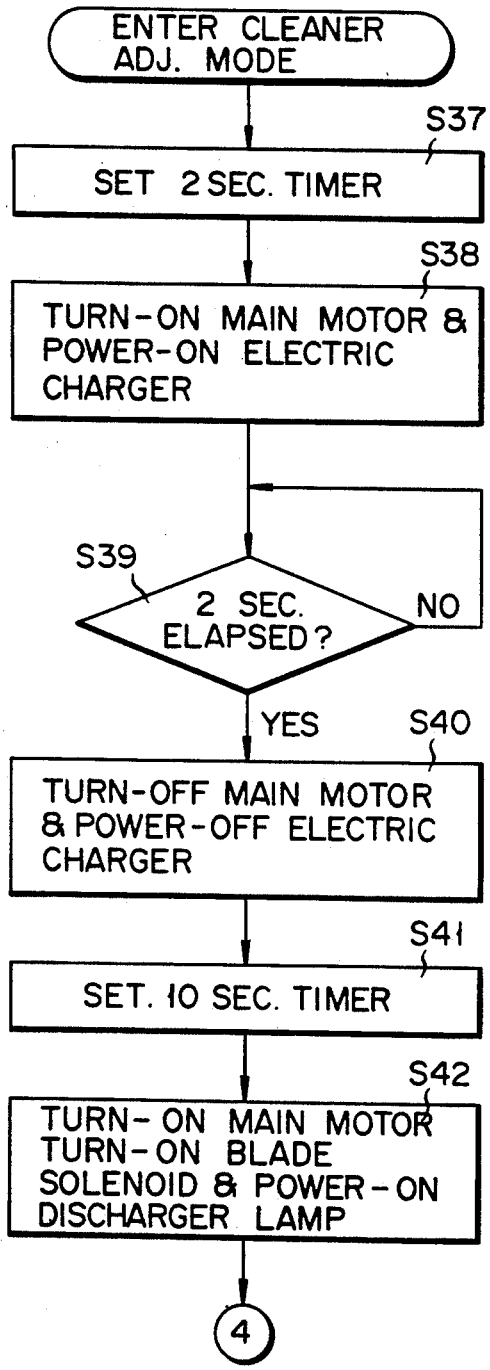
FIGS. 8A–8B are flow charts explaining the operation of a cleaner adjustment mode of the invention.
Figure 8B:
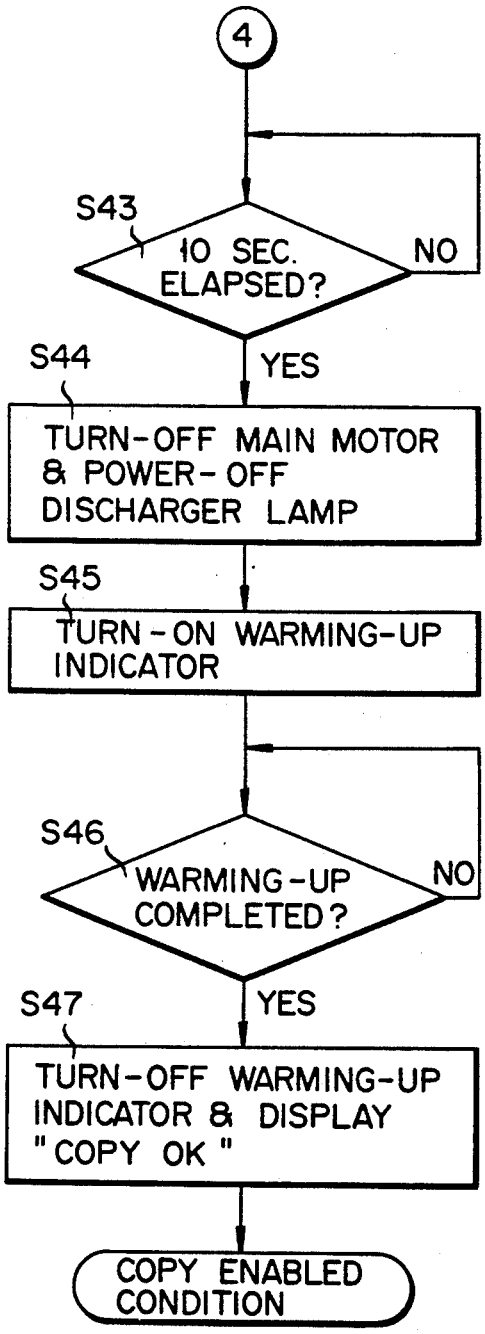
Figure 10:
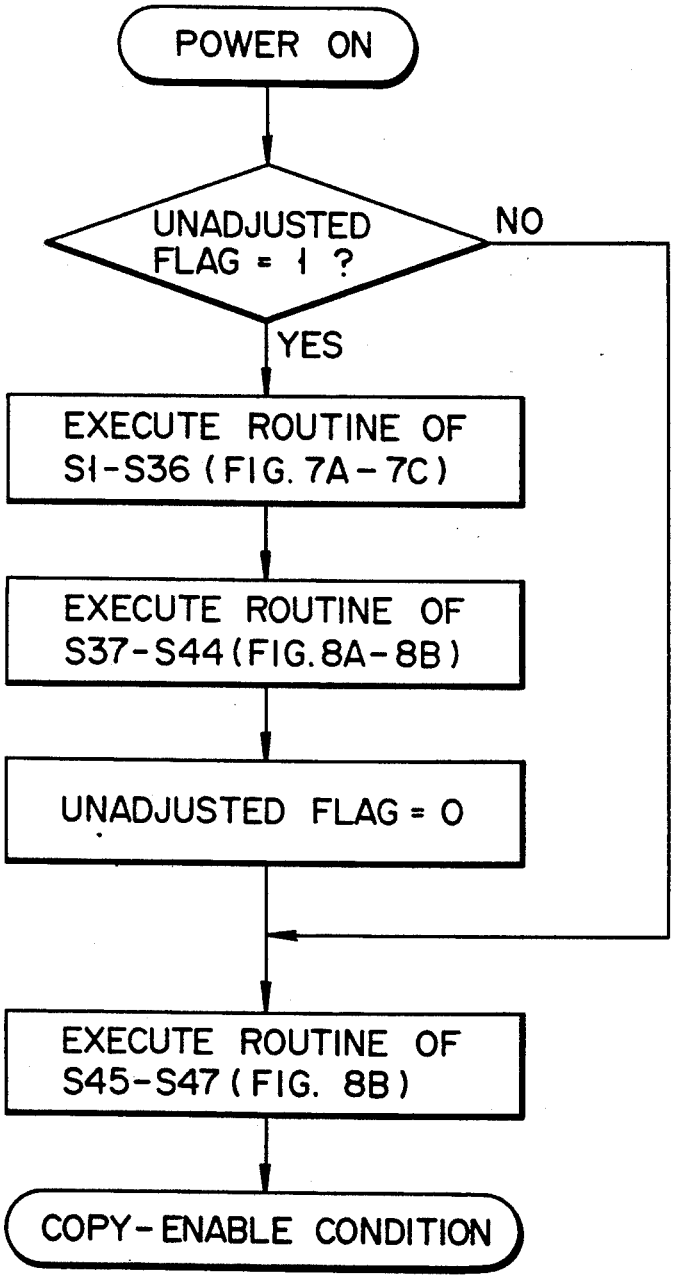
FIG. 10 is a flow chart explaining an adjustment operation in another embodiment of the invention.

In this case, the adjustment operation is performed in accordance with a flow chart shown in FIG. 10. That is, when the power switch is turned on, whether an unadjusted flag is "1" is checked. This unadjusted flag is set to "1" when, e.g., a copying machine is shipped from a factory. If the unadjusted flag is determined to be "1", it is determined that the sensor and the cleaner are unadjusted. Therefore, a routine of steps S1 to S36 in FIG. 7 are executed, and subsequently a routine of steps S37 to S44 in FIG. 8 are executed. When the processing step S44 is ended, the unadjusted flag is set to "0", a routine of steps S45 to S47 in FIG. 8 is executed to set the copy enable condition. If the unadjusted flag is not determined to be "1", it is determined that the sensor and the cleaner are already adjusted, and the routine of steps S45 to S47 in FIG. 8 is executed to set the copy enable condition. In this manner, the adjustment operation can be automatically performed only when the power switch is turned on for the first time after a package is open.

In the above embodiment, the electric copying machine is exemplified as the image forming apparatus. The present invention, however, is not limited to the above embodiment but can be applied to, e.g., a laser printer or an electronic printer.

As has been described above, according to the image forming apparatus of the present invention, since an adjustment of the toner concentration detecting means can be automatically performed with high precision, the adjustment does not require much labor or time. Therefore, an adjustment time can be reduced and an adjustment operation can be simplified, thereby achieving a great effect especially upon unpacking.

In addition, according to the image forming apparatus of the present invention, an adjustment of the cleaning means can be automatically performed subsequently sequent to the adjustment of the toner concentration detecting means. Therefore, since the adjustment does not require much labor or time, an adjustment time can be reduced and an adjustment operation can be simplified, thereby achieving a great effect especially upon unpacking.

While the invention has been described in connection with what is presently considered to be the most practical and preferred embodiment, it is to be understood that the invention is not limited to the disclosed embodiment but, on the contrary, is intended to cover various modifications and equivalent arrangements included within the scope of the appended claims, which scope is to be accorded the broadest interpretation so as to encompass all such modifications and equivalent arrangements.

What is claimed is:

1. An initial adjustment system for an image forming apparatus, comprising:

means for forming a latent image of an original on a photosensitive body;

means for supplying the photosensitive body with a toner, so as to develop the latent image and thereby obtain a toner image;

means for transferring the toner image onto an image forming medium;

means for detecting as an image forming condition a concentration of the toner, to provide a detection result;

means for comparing predetermined reference data with input data representing said detection result, so as to provide first input data when the input data is less than the reference data, and to provide second output data when the input data is larger than the reference data, said second output data being less than said first output data; and means for controlling said detecting means in accordance with either of said first and second output data, so that a difference between the reference data and the input data is reduced to a predetermined value.

2. An initial adjustment system for an image forming apparatus, comprising:

means for forming a latent image of an original on a photosensitive body;

means for supplying the photosensitive body with a developer material containing a toner, so as to develop the latent image and thereby obtain a toner image;

means for transferring the toner image onto an image forming medium;

means for detecting as an image forming condition a concentration of the toner in the developer material, to provide a detection result;

means for performing an adjustment of said image forming condition in accordance with said detection result, the adjustment by said performing means being performed in accordance with a predetermined adjustment sequence when the image forming apparatus is installed;

means for cleaning the toner on the photosensitive body; and means for controlling the supply of the toner to the photosensitive body, as well as cleaning of the toner at the photosensitive body, in accordance with a predetermined cleaning sequence.

3. An initial adjustment system for an image forming apparatus, comprising:

means for forming a latent image of an original on a photosensitive body;

means for supplying the photosensitive body with a developer material containing a toner, so as to develop the latent image and thereby obtain a toner image;

means for transferring the toner image onto an image forming medium;

means for detecting as an image forming condition a concentration of the toner in the developer material, to provide a detection result;

means for performing an adjustment of said image forming condition in accordance with said detection result, the adjustment by said performing means being performed in accordance with a predetermined adjustment sequence when the image forming apparatus is installed;

means for scraping the toner off the photosensitive body; and means for controlling the supply of the toner to the photosensitive body, as well as scraping the toner off the photosensitive body, in accordance with a predetermined second sequence.

4. An initial adjustment system for an image forming apparatus, comprising:

a) first means for forming an image of an original, including:

means for capturing a latent image of the original;

means for developing the latent image using a developer material containing a toner, to provide a toner image; and means for transferring the toner image onto an image forming medium;

b) second means for detecting as an image forming condition of said first means, including:

means for detecting as said image forming condition a concentration of the toner in the developer material, to provide a detection result; and means for performing an adjustment of said image forming condition in accordance with said detection result, the adjustment by said performing means being performed in accordance with a predetermined adjustment sequence when the image forming apparatus is adjusted at a place of installation, and c) third means for manipulating a state of the toner, including:

means for sticking the toner to the capturing means;

means for cleaning the toner on the capturing means; and means for controlling the toner sticking and the toner cleaning in accordance with a predetermined cleaning sequence.

5. A system according to claim 4, wherein said controlling means includes:

means for automatically performing, after said predetermined adjustment sequence is completed, said predetermined cleaning sequence by which said sticking means performs an operation of the toner sticking and then said cleaning means performs an operation of the toner cleaning.

6. A system according to claim 4, wherein said first means includes means for forming an electrostatic image of the original on the image forming medium, using the developer material formed of a magnetic toner and a carrier, and said second means includes means for detecting the magnetic reluctance of the developer material to provide said detection result which represents the concentration of said toner.

7. A system according to claim 4, further comprising:

means for retaining a concentration of the toner at a prescribed constant value.

8. A system according to claim 4, wherein i) said first means includes:

means for forming an electrostatic image of the original on the image forming medium, using the developer material formed of a toner having magnetism and a carrier, and ii said second means includes:

means for sensing a reluctance of the developer material to provide a toner concentration signal depending on the concentration of said toner;

means for comparing the toner concentration signal with a reference signal, to provide said detection result;

means for changing said detection result in response to a control signal; and means for controlling an amount of supply of the toner in accordance with said detection result, so that a concentration of the toner in said developer material is kept substantially at a constant value defined by said control signal.

9. An initial adjustment system for an image forming apparatus, comprising:

means for capturing a latent image of an original;

means for developing the latent image using a developer material containing a toner, to provide a toner image;

means for transferring the toner image onto an image forming medium;

means for detecting as an image forming condition a concentration of the toner in the developer material, to provide a detection result;

means for performing an adjustment of said image forming condition in accordance with said detection result, the adjustment by said performing means being performed in accordance with a first computer sequence when the image forming apparatus is to be adjusted at the place of installation;

means for sticking the toner to the capturing means;

means for scraping the toner off the capturing means; and means for controlling the toner sticking and the toner scraping-off in accordance with a second computer sequence.

10. A system according to claim 9, further comprising:

means for retaining a concentration of the toner at a prescribed constant value.

11. A system according to claim 9, wherein said controlling means includes:

means for automatically performing said second computer sequence after said first computer sequence is completed, wherein said sticking means performs the toner sticking and then said scraping means performs the toner scraping-off.

12. A system according to claim 9, further comprising means for forming an electrostatic image of the original onto the image forming medium, using a developer material which is formed of a toner having magnetism and a carrier, and means for detecting a reluctance of the developer material to provide said detection result which represents the concentration of said toner.

13. A system according to claim 12, wherein said detecting means includes:

means for sensing a reluctance of the developer material to provide a toner concentration signal depending on the concentration of said toner;

means for comparing the toner concentration signal with a reference signal to provide said detection result;

means for setting said detection result in response to a setting signal; and means for controlling an amount of supply of the toner in accordance with said detection result, so that a concentration of the toner in said developer material is substantially kept at a constant value which depends on said setting signal.

14. A system according to claim 9, further comprising:

means for checking whether or not the adjustment of the toner concentration is completed, and, if not, executing the toner concentration adjustment.

* * * * *